US005743336A

United States Patent [19]

Davis

[11] Patent Number: 5,743,336

[45] Date of Patent: Apr. 28, 1998

[54] PUMP-PACKING DEVICE FOR DOWN-HOLE WELL ARRANGEMENTS

[75] Inventor: Bob G. Davis, Hobbs, N. Mex.

[73] Assignee: Bull Dog Tool, Inc., Hobbs, N. Mex.

[21] Appl. No.: 718,116

[22] Filed: Sep. 18, 1996

[51] Int. Cl.[6] ..... F04B 47/00; F04B 53/02

[52] U.S. Cl. ..... 166/380; 166/68; 166/105; 277/123; 277/167.3; 417/554

[58] Field of Search ..... 166/68, 101, 105, 166/105.1, 106, 108, 380; 417/554, 553, 552, 550, 549; 277/123, 167.3, 168, 180

[56] References Cited

U.S. PATENT DOCUMENTS

| | | | |
|---|---|---|---|
| 1,135,821 | 4/1915 | Kraeer | 166/105.2 |
| 1,487,431 | 3/1924 | Barger | 166/105.2 |
| 1,502,955 | 7/1924 | Johnson | 417/451 |
| 1,523,161 | 1/1925 | Attebery | 166/105.1 |
| 1,559,606 | 11/1925 | Gray | 417/520 |
| 1,852,920 | 5/1932 | Combs | 166/105.2 |
| 2,081,225 | 5/1937 | Coberly | 166/105.1 |
| 2,143,836 | 1/1939 | Anderson | 166/105.1 |
| 2,548,127 | 4/1951 | Slavens | 15/220.4 |
| 2,664,828 | 1/1954 | Le Bus | 166/105.2 |
| 3,216,731 | 11/1965 | Dollison | 277/1 |
| 3,840,072 | 10/1974 | Hutchinson | 166/84.1 |
| 3,983,938 | 10/1976 | Hellums et al. | 166/175 |
| 4,494,607 | 1/1985 | Ford et al. | 166/311 |
| 4,815,538 | 3/1989 | Burroughs | 166/312 |
| 4,880,062 | 11/1989 | Bland et al. | 417/554 X |
| 5,058,668 | 10/1991 | Newton | 166/84.1 |
| 5,257,812 | 11/1993 | Osorio et al. | 166/84.1 |
| 5,314,025 | 5/1994 | Priestly | 166/105 X |
| 5,618,169 | 4/1997 | Smith | 417/554 |

*Primary Examiner*—David J. Bagnell

*Attorney, Agent, or Firm*—Burns, Doane, Swecker & Mathis, LLP

[57] ABSTRACT

In a down-hole well arrangement, an insert pump having a pump barrel is provided, the pump barrel having a top end and a bottom end. Tubing for the down-hole well is also provided, the tubing including one or more tubing members, a seating nipple, and a tubular member having a first end attached to the seating nipple and a second end. A pump-packing device is provided, the pump-packing device having a tubular body having a bottom end attached to the second end of the tubular member and a top end attached to one of the one or more tubing members. The pump-packing device includes one or more annular spacer members, the spacer members being disposed inside the tubular body and having a first inside diameter, and one or more annular flexible elements supported inside the tubular body by the spacer members and having a second inside diameter smaller than the first inside diameter, the second inside diameter being sufficiently large to permit the pump barrel to be removably inserted through the flexible elements. The tubular body and the tubular member are of sufficient length such that, when the bottom end of the pump barrel is disposed proximate the seating nipple, the flexible elements are disposed proximate and below the top end of the pump barrel.

15 Claims, 3 Drawing Sheets

PUMP-PACKING DEVICE FOR DOWN-HOLE WELL ARRANGEMENTS

FIELD OF THE INVENTION

The present invention relates to pumping arrangements for down-hole well operations and, more particularly, to methods and apparatus for preventing insert pumps from sticking in down-hole well tubing.

BACKGROUND AND SUMMARY OF THE INVENTION

A typical insert pump for normal oil well artificial lift installations in 2⅜" outside diameter (1.996" inside diameter) down-hole tubing includes a 1⅞" outside diameter pump barrel that is about sixteen feet in length, with a plunger and valves inside of the barrel. The pump is run on sucker rods into the well inside the tubing until the bottom of the pump engages a seating nipple in the tubing at a selected pumping depth. A cup-type packing on the bottom of the pump barrel seals the annulus between the pump-barrel and the tubing. Pumping action is obtained by reciprocating the sucker rods and the pump plunger with a vertical stroke that generally varies from 64" to 144". The pump action lifts fluid from below the pump seat through the pump barrel and discharges from the pump at the top of the barrel to be lifted through the tubing to the surface with successive strokes of the pump.

As pumped fluid discharges at the top of the pump barrel, scale, sand, and other debris often settles down into the close-fit annulus between the pump barrel and the tubing, thus increasing the probability of sticking of the pump barrel in the tubing. When the pump barrel gets stuck in the tubing such that the sucker rods and the insert pump cannot be pulled from the well, the tubing and the sucker rods must be pulled from the well bore simultaneously in an operation called "stripping out". This operation takes considerably more time than simply pulling out the sucker rods, and results in significant additional expense. It is, accordingly, desirable to find a way to prevent sticking of pump barrels in tubing due to settling of debris between the pump barrel and the tubing.

According to one aspect of the present invention, an arrangement in a down-hole well is provided. The arrangement includes an insert pump, the pump having a pump barrel and a plunger, the plunger being reciprocable inside the pump barrel, the pump barrel having a top end and a bottom end. The arrangement further includes tubing for the down-hole well, the tubing including one or more tubing members, a seating nipple, and a tubular member having a first end attached to the seating nipple and a second end. The arrangement further includes a pump-packing device, the pump-packing device having a tubular body having a bottom end attached to the second end of the tubular member and a top end attached to one of the one or more tubing members, the pump-packing device including one or more annular spacer members, the spacer members being disposed inside the tubular body and having a first inside diameter, and one or more annular flexible elements supported inside the tubular body by the spacer members and having a second inside diameter smaller than the first inside diameter. The second inside diameter is sufficiently large to permit the pump barrel to be removably inserted through the flexible elements. The tubular body and the tubular member are of sufficient length such that, when the bottom end of the pump barrel is disposed proximate the seating nipple, the flexible elements are disposed proximate and below the top end of the pump barrel.

According to another aspect of the present invention, a pump-packing device for an arrangement in a down-hole well is provided. The arrangement includes an insert pump, the pump having a pump barrel and a plunger, the plunger being reciprocable inside the pump barrel, the pump barrel having a top end and a bottom end, tubing for the down-hole well, the tubing including one or more tubing members, a seating nipple, and a tubular member having a first end attached to the seating nipple. The pump-packing device includes a tubular body having a first end attachable to the tubular member and a second end attachable to one of the tubing members. The pump-packing device further includes one or more annular spacer members, the spacer members being disposed inside the tubular body and having a first inside diameter. The pump-packing device further includes one or more annular flexible elements supported inside the tubular body by the spacer members and having a second inside diameter smaller than the first inside diameter, the second inside diameter being sufficiently large to permit the pump barrel to be removably inserted through the flexible elements. The tubular body and the tubular member are of sufficient length such that, when the bottom end of the pump barrel is disposed proximate the seating nipple, the flexible elements are disposed proximate and below the top end of the pump barrel.

According to still another aspect of the present invention, a method for installing well tubing and an insert pump in a down-hole well is disclosed. According to the method, a seating nipple is installed in a down-hole well at a pumping depth, and a first end of a tubular member is attached to the seating nipple, the tubular member having a second end. A pump-packing device is attached to the tubular member, the pump-packing device including a tubular body having a first end attachable to the tubular member and a second end, one or more annular spacer members, the spacer members being disposed inside the tubular body and having a first inside diameter, and one or more annular flexible elements supported inside the tubular body by the spacer members and having a second inside diameter smaller than the first inside diameter. Well tubing is attached to the second end of the pump-packing device. An insert pump having a pump barrel, the pump barrel having a top end and a bottom end, is lowered through the tubing, the pump-packing device, and the tubular member until the bottom end of the insert pump is disposed proximate the seating nipple. The second inside diameter of the flexible members is sufficiently large to permit the pump barrel to be removably inserted through the flexible elements, and the pump-packing device and the tubular member are of sufficient length such that, when the bottom end of the pump barrel is disposed proximate the seating nipple, the flexible elements are disposed proximate and below the top end of the pump barrel.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
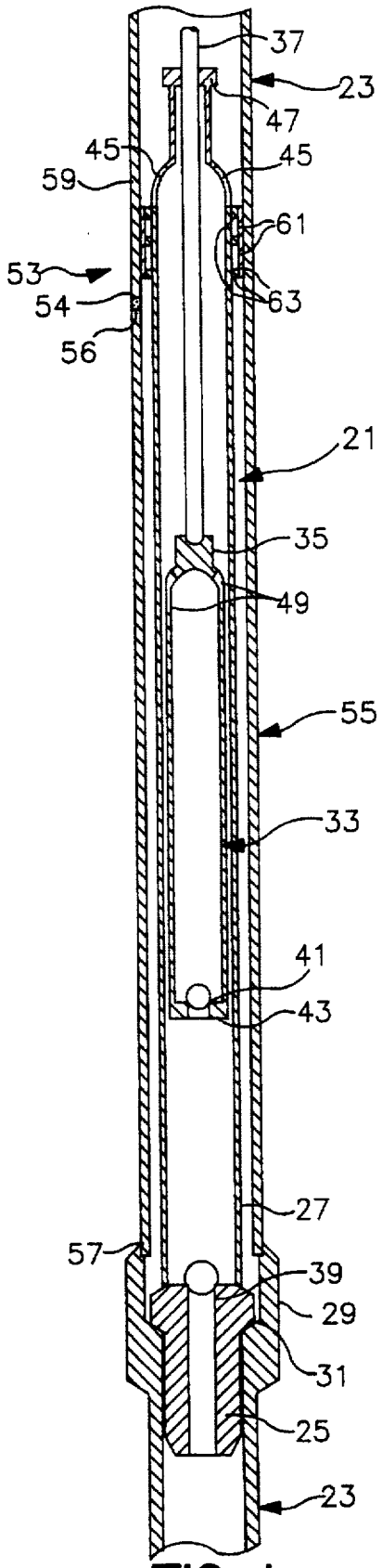
FIG. 1 is a cross-sectional view of an arrangement of a pump-packing device, tubing, and an insert pump in a down-hole well according an embodiment of the present invention.

In a typical down-hole well as shown schematically in cross-section in FIG. 1, an insert pump 21 is extended through tubing 23 until a bottom 25 of the pump barrel 27 engages a seating nipple 29 in the tubing at a selected pumping depth. A cup-type packing 31 on the bottom 25 of the pump barrel 27 seals an annulus between the pump barrel and the tubing 23. A pump plunger 33 is attached, at its top end 35, to sucker rods 37 and is reciprocated inside of the pump barrel 27. A one-way valve 39 on the bottom 25 of the pump barrel 27 and a one-way valve 41 on the bottom 43 of the plunger 33 permit liquid being pumped to enter the pump barrel and the plunger without escaping back down the well or out of the plunger. Openings 45 at the top 47 of the pump barrel 27 and openings 49 at the top 35 of the plunger 33 permit liquid being pumped to be moved upwardly in the well when the plunger reciprocates.

Below the openings 45 at the top of the pump barrel, what will be referred to as a "pump-packing" device 53 is connected in line with the well tubing 23. The pump-packing device 53 is in the form of a tubular body and is attached at a first or bottom end 54 thereof, such as by conventional threaded connections, to a top 56 of a tubular member 55. The tubular member 55 has a first or bottom end 57 attachable, such as by conventional male-female threaded connections, to the seating nipple 29. The pump-packing device 53 is attached at a second or top end 59 to the tubing 23, such as by conventional threaded connections.

One or more, preferably two, annular spacer members 61 are disposed inside of the pump-packing device 53 and have a first inside diameter. One or more, preferably three, annular flexible elements 63, preferably in the form of flat rubber rings, are supported inside of the pump-packing device 53 by the spacer members 61 and have a second inside diameter smaller than the first inside diameter. The second inside diameter is sufficiently large to permit the pump barrel 27 to be removably inserted through the flexible elements 63. The overall length of the pump-packing device 53 and the tubing 55, when connected, is such that, when the bottom end 25 of the pump barrel 27 engages with the seating nipple 29, the flexible elements 63 of the pump-packing device 53 are disposed proximate and below the top end 47 of the pump barrel below the openings 45 at the top of the pump barrel.

Figure 2:
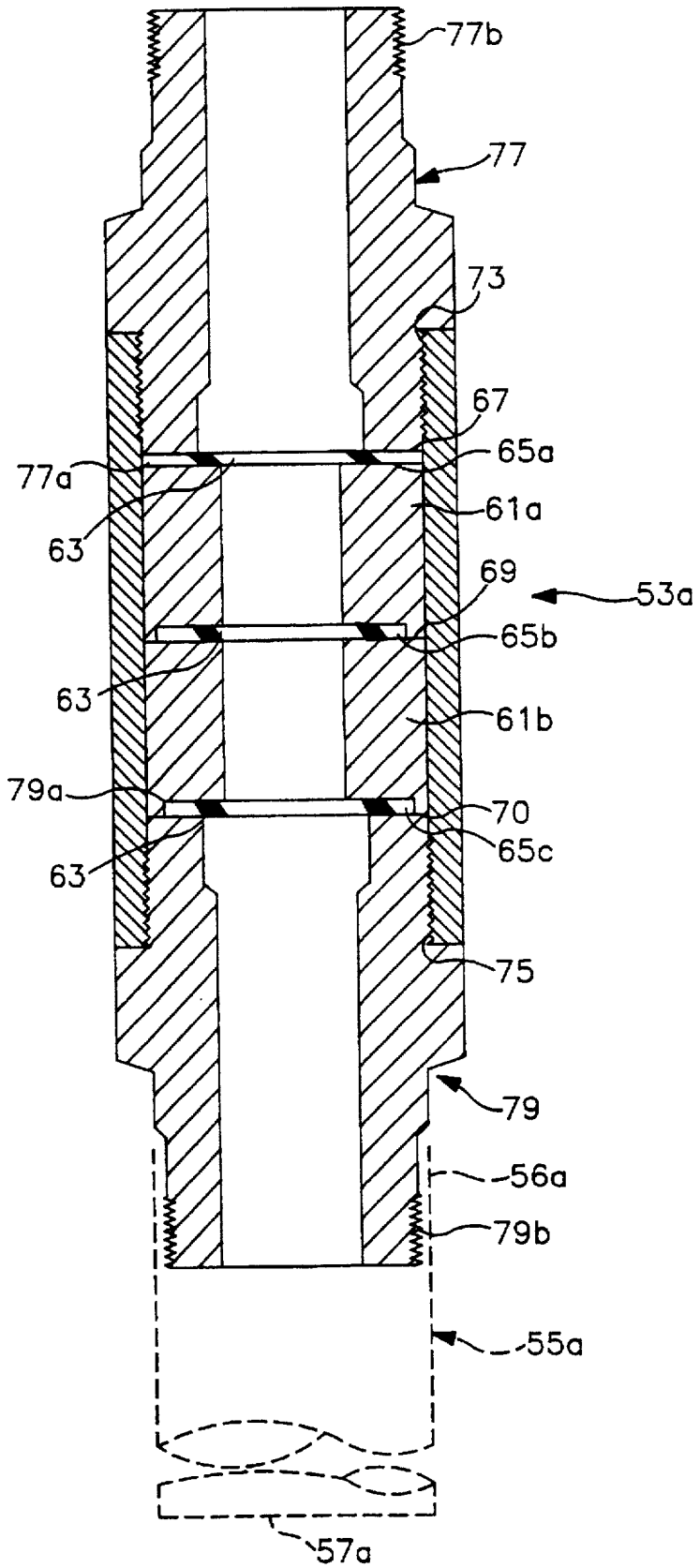
FIG. 2 is a cross-sectional view of a pump-packing device according to one embodiment of the present invention.

An embodiment of the pump-packing device 53*a* is shown in FIG. 2 and preferably includes a first spacer element 61*a* and a second spacer element 61*b*. The first spacer element 61*a* and the second spacer element 61*b* are disposed adjacent to each other in contact with each other inside of the tubular body. In this embodiment, the first spacer element 61*a* includes two annular recesses 65*a*, 65*b* on an inside perimeter of the first spacer element at top and bottom ends 67, 69 of the first spacer element, and the second spacer element 61*b* includes one annular recess 65*c* on an inside perimeter of the second spacer element at a bottom end 70 of the second spacer element.

The pump-packing device 53*a* according to the embodiment shown in FIG. 2 includes three flexible members 63. The three flexible members 63 are supported by the spacer members 61*a*, 61*b* by outside portions of the three flexible members being received in the annular recesses 65*a*, 65*b*, 65*c* on the first spacer element and the second spacer element.

The two outer flexible members 63 are preferably further held in place by tubing fittings for attaching the pump-packing device 53*a* in line with the tubing 23 and the tubular member 55. In the embodiment shown in FIG. 2, the pump-packing device 53*a* has a top female end 73 and a bottom female end 75. Two male tubing fittings 77, 79 are attached to the female ends 73, 75, respectively, with ends 77*a* and 79*a* of the male fittings assisting in holding the flexible members in position. The tubular member 55*a* (shown by dotted lines) is attached at its top end 56*a* to the other end 79*b* of the male fitting 79. The tubular member 55*a* is preferably conventional piping or tubing like the tubing 23 and is of sufficient length such that, when the bottom end 25 of the pump barrel 27 engages with the seating nipple 29, the flexible elements 63 are disposed proximate and below the top end 47 of the pump barrel below the openings 45 at the top of the pump barrel. The end 77*b* of the male fitting 77 forms the top end 59 of the pump-packing device 53*a* and is preferably attached to the well tubing 23. The male fittings 77 and 79 may, if desired or necessary, be reversed so that the end 79*b* is attached to the well tubing 23 and the end 77*b* is attached to the tubular member 55*a*. The bottom end 57*a* of the tubular member 55*a* is attached to the seating nipple 29.

Figure 3:
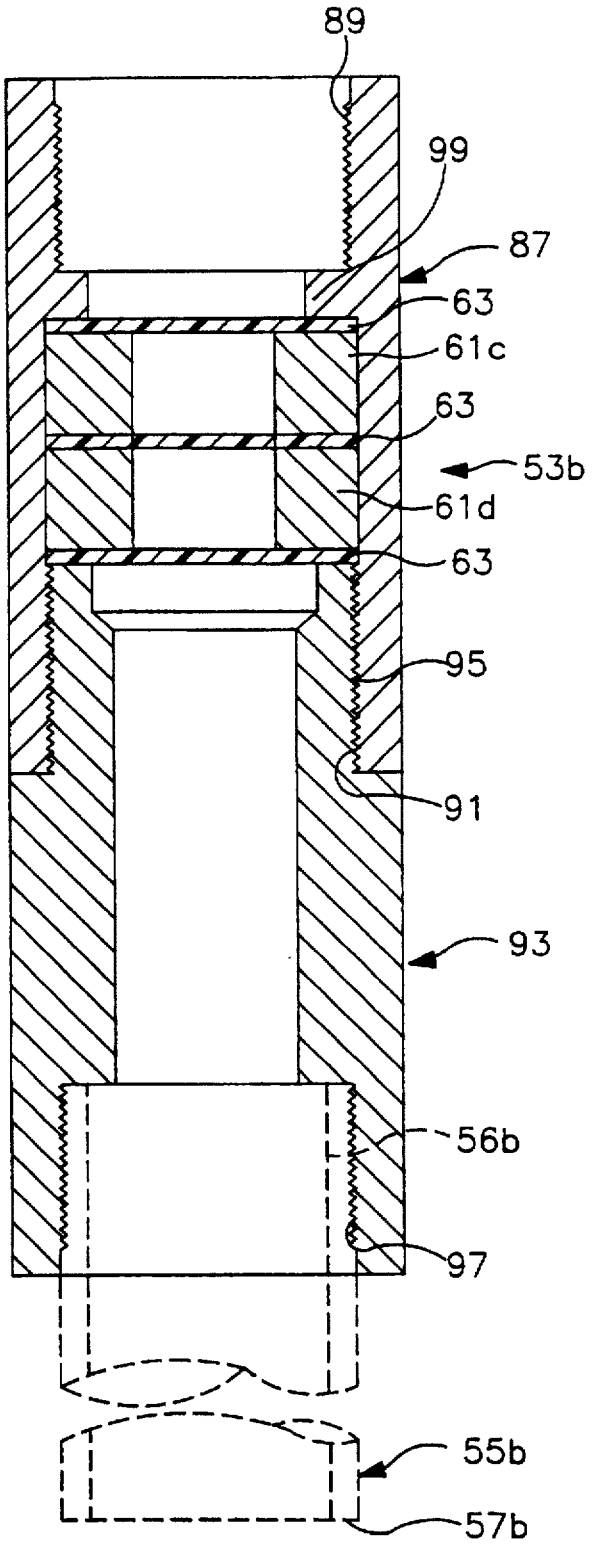
FIG. 3 is a cross-sectional view of a pump-packing device according to another embodiment of the present invention.

Another embodiment of a pump-packing device 53*b* is shown in FIG. 3. In this embodiment, three flexible members 63 are supported between two spacer members 61*c*, 61*d*. The pump-packing device 53*b* preferably has a first tubing section 87 having a first end 89 having female threads and a second end 91 having female threads. The pump-packing device 53*b* also includes a second tubing section 93 having a first end 95, the first end of the second tubing section having a male thread that mates with the female threads at the second end 91 of the first tubing section 87 and a second end 97 having female threads that are preferably of the same size as the female threads at the first end of the first tubing section. The first tubing section 87 has an internal ridge 99.

One of the flexible members 63 is disposed between the internal ridge 99 and the first spacer member 61*c*; a second one of the flexible members is disposed between the first spacer member and the second spacer member 61*d*; and the third one of the flexible members is disposed between the second spacer member and the first end 95 of the second tubing section 93.

The tubular member 55*b* (shown by dotted lines) is attached at a first or top end 56*b* thereof to the second end 97 of the second tubing section 93. A second or bottom end 57*b* of the tubular member 55*b* is preferably attached to the seating nipple 29. The tubular member 55*b* is preferably of sufficient length such that, when the bottom end 25 of the pump barrel 27 engages with the seating nipple 29, the flexible elements 63 are disposed proximate and below the top end 47 of the pump barrel below the openings 45 at the top of the pump barrel. The first end 89 of the first tubing section 87 is preferably attached to the well tubing 23. If desired or necessary, the first end of the first tubing section 87 may be attached to the first or top end 56*b* of the tubular member 55*b* and the second end 97 of the second tubing section 93 may be attached to the well tubing 23, i.e., the entire pump-packing device 53*b* can be reversed.

If desired or necessary, various changes can be made to the illustrated embodiments of the invention. For example, if desired or necessary, the contacting, recessed spacer members and associated flexible elements disclosed in connection with the embodiment illustrated in FIG. 2 can be substituted for the non-contacting spacer members and associated flexible elements disclosed in connection with the embodiment illustrated in FIG. 3, and vice versa. The illustrated embodiments all show three flexible elements and two spacer members, however, it will be appreciated that fewer or more flexible elements and spacer members can be provided if desired or necessary. While the pump-packing device and arrangement according to the present invention has particular utility in oil well operations, as has been demonstrated through field testing of pump-packing devices made according to the embodiment illustrated in FIG. 3, the pump-packing device and arrangement is useful in any down-hole operation for pumping any type of liquid or slurry.

A method for installing well tubing and an insert pump in a down-hole well according to the present invention is described with reference to FIG. 1. A seating nipple 29 is installed in a down-hole well at a pumping depth and bottom end 57 of a tubular member 55 is attached to the seating nipple. A pump-packing device 53 is attached to the top end 56 of the tubular member 55.

The pump-packing device 53 includes one or more annular spacer members 61, the spacer members being disposed inside the tubular member 55 and having a first inside diameter, and one or more annular flexible elements 63 supported inside the tubular member by the spacer members and having a second inside diameter smaller than the first inside diameter. Well tubing 23 is attached to a second or top end 59 of the pump-packing device 53. An insert pump 21 is lowered through the tubing 23 and the pump-packing device 53 until a bottom 25 of the pump barrel 27 of the insert pump is disposed proximate the seating nipple 29. The second inside diameter of the flexible members 63 is sufficiently large to permit the pump barrel 27 to be removably inserted through the flexible elements 63, and the pump-packing device 53 and the tubular member 55 are of sufficient length such that, when the bottom end 25 of the pump barrel 27 is disposed proximate the seating nipple 29, the flexible elements are disposed proximate and below the top end of the pump barrel, i.e., below the openings 45 at the top 47 of the pump barrel.

While this invention has been illustrated and described in accordance with a preferred embodiment, it is recognized that variations and changes may be made therein without departing from the invention as set forth in the claims.

What is claimed is:

1. An arrangement in a down-hole well, comprising:

an insert pump, the pump having a pump barrel and a plunger, the plunger being reciprocable inside the pump barrel, the pump barrel having a top end and a bottom end;

tubing for the down-hole well, the tubing including one or more tubing members, a seating nipple, and a tubular member having a first end attached to the seating nipple and a second end;

a pump-packing device, the pump-packing device having a tubular body having a bottom end attached to the second end of the tubular member and a top end attached to one of the one or more tubing members, the pump-packing device including one or more annular spacer members, the spacer members being disposed inside the tubular body and having a first inside diameter, and one or more annular flexible elements supported inside the tubular body by the spacer members and having a second inside diameter smaller than the first inside diameter, the second inside diameter being sufficiently large to permit the pump barrel to be removably inserted through the flexible elements, wherein the tubular body and the tubular member are of sufficient length such that, when the bottom end of the pump barrel is disposed proximate the seating nipple, the flexible elements are disposed proximate and below the top end of the pump barrel.

2. The arrangement as set forth in claim 1, wherein the pump-packing device includes a first spacer element and a second spacer element.

3. The arrangement as set forth in claim 2, wherein the first spacer element and the second spacer element are disposed adjacent to each other inside the tubular body.

4. The arrangement as set forth in claim 3, wherein the first spacer element includes two annular recesses on an inside perimeter thereof at top and bottom ends thereof, and the second spacer element includes one annular recess on an inside perimeter thereof at a top end thereof, the pump-packing device including three flexible members, the three flexible members being supported by the spacer members by outside portions of the three flexible members being received in the annular recesses on the first spacer element and the second spacer element.

5. The arrangement as set forth in claim 2, wherein the pump-packing device includes three flexible members, a first one of the three flexible members being supported against a top surface of the first spacer element, a second one of the three flexible members being supported against a bottom surface of the first spacer element and against a top surface of the second spacer element, and a third one of the three flexible members being supported against a bottom surface of the second spacer element.

6. The arrangement as set forth in claim 5, wherein the tubular body includes an internal annular ridge, the third one of the three flexible members being supported against a top surface of the annular ridge.

7. The arrangement as set forth in claim 1, wherein the tubular body includes a first section in which the spacer elements are disposed and a second section.

8. A pump-packing device for an arrangement in a down-hole well, the arrangement including an insert pump, the pump having a pump barrel and a plunger, the plunger being reciprocable inside the pump barrel, the pump barrel having a top end and a bottom end, and tubing for the down-hole well, the tubing including one or more tubing members, a seating nipple, and a tubular member having a first end attached to the seating nipple, the pump-packing device comprising:

a tubular body having a first end attachable to the tubular member and a second end attachable to one of the tubing members;

one or more annular spacer members, the spacer members being disposed inside the tubular body and having a first inside diameter; and one or more annular flexible elements supported inside the tubular body by the spacer members and having a second inside diameter smaller than the first inside diameter, the second inside diameter being sufficiently large to permit the pump barrel to be removably inserted through the flexible elements, wherein the tubular body and the tubular member are of sufficient length such that, when the bottom end of the pump barrel is disposed proximate the seating nipple, the flexible elements are disposed proximate and below the top end of the pump barrel.

9. The pump-packing device as set forth in claim 8, wherein the pump-packing device includes a first spacer element and a second spacer element.

10. The pump-packing device as set forth in claim 9, wherein the first spacer element and the second spacer element are disposed adjacent to each other inside the tubular body.

11. The pump-packing device as set forth in claim 10, wherein the first spacer element includes two annular recesses on an inside perimeter thereof at top and bottom ends thereof, and the second spacer element includes one annular recess on an inside perimeter thereof at a top end thereof, the pump-packing device including three flexible members, the three flexible members being supported by the spacer members by outside portions of the three flexible members being received in the annular recesses on the first spacer element and the second spacer element.

12. The pump-packing device as set forth in claim 9, wherein the pump-packing device includes three flexible members, a first one of the three flexible members being supported against a top surface of the first spacer element, a second one of the three flexible members being supported against a bottom surface of the first spacer element and against a top surface of the second spacer element, and a third one of the three flexible members being supported against a bottom surface of the second spacer element.

13. The pump-packing device as set forth in claim 12, wherein the tubular body includes an internal annular ridge, the third one of the three flexible members being supported against a top surface of the annular ridge.

14. The pump-packing device as set forth in claim 8, wherein the tubular body includes a first section in which the spacer elements are disposed and a second section.

15. A method for installing well tubing and an insert pump in a down-hole well, comprising the steps of:

installing a seating nipple in a down-hole well at a pumping depth;

attaching a first end of a tubular member to the seating nipple, the tubular member having a second end;

attaching a pump-packing device to the tubular member, the pump-packing device including a tubular body having a first end attachable to the tubular member and a second end, one or more annular spacer members, the spacer members being disposed inside the tubular body and having a first inside diameter, and one or more annular flexible elements supported inside the tubular body by the spacer members and having a second inside diameter smaller than the first inside diameter;

attaching well tubing to the second end of the pump-packing device;

lowering an insert pump having a pump barrel, the pump barrel having a top end and a bottom end, through the tubing, the pump-packing device, and the tubular member until the bottom end of the insert pump is disposed proximate the seating nipple, wherein the second inside diameter of the flexible members is sufficiently large to permit the pump barrel to be removably inserted through the flexible elements, and the pump-packing device and the tubular member are of sufficient length such that, when the bottom end of the pump barrel is disposed proximate the seating nipple, the flexible elements are disposed proximate and below the top end of the pump barrel.

* * * * *